United States Patent [19]

Koga et al.

[11] Patent Number: 4,513,702

[45] Date of Patent: Apr. 30, 1985

[54] INTERNAL COMBUSTION ENGINE

[75] Inventors: Noritaka Koga; Takanori Suzuki, both of Sakado; Kenji Nakamura, Wako; Hitoshi Suzuki; Takeo Ogano, both of Kawagoe, all of Japan

[73] Assignee: Honda Giken Kogyo Kabushiki Kaisha, Tokyo, Japan

[21] Appl. No.: 423,260

[22] Filed: Sep. 24, 1982

[30] Foreign Application Priority Data

Oct. 29, 1981 [JP] Japan ..... 56-174338
Oct. 30, 1981 [JP] Japan ..... 56-162109[U]

[51] Int. Cl.[3] ..... F02F 7/00

[52] U.S. Cl. ..... 123/193 H; 123/196 W; 123/90.31

[58] Field of Search ..... 123/195 R, 195 C, 195 HJ, 123/90.31, 196 W, 90.17, DIG. 7

[56] References Cited

U.S. PATENT DOCUMENTS 1,108,265 8/1914 Spacke et al. ..... 123/90.31
2,057,354 10/1936 Withers et al. ..... 123/90.17
2,218,332 10/1940 Fowler ..... 123/DIG. 7
2,346,148 4/1944 Bosma ..... 123/196 W
2,682,260 6/1954 Lantz ..... 123/90.17
3,144,097 8/1964 Ebert ..... 123/196 W

FOREIGN PATENT DOCUMENTS 54-27615 3/1979 Japan .

*Primary Examiner*—Craig R. Feinberg
*Attorney, Agent, or Firm*—Armstrong, Nikaido, Marmelstein & Kubovcik

[57] ABSTRACT

An internal combustion engine is provided which comprises an outside member including a cylinder block section and a crankcase half section which are both casted into a single body, the crankcase having an opening formed therein which has an opening edge arranged in an inclined relationship to the center axis of a cylinder and also to the center axis of a crankshaft, and a crankcase half having a corresponding opening edge thereon for covering the opening of the crankcase half section.

The inclined opening of the crankcase half section facilitates working of the inside of the crankcase half section and the cylinder block section and assembling of internal parts within the outside member.

2 Claims, 7 Drawing Figures

INTERNAL COMBUSTION ENGINE

BACKGROUND OF THE INVENTION

1. Field of the Invention

This invention relates to an internal combustion engine, and more particularly to a four cycle engine of the type including a crankshaft.

2. Description of Relevant Art

An outside member of an internal combustion engine is conventionally constituted either from four components including a cylinder head, a cylinder block and a crankcase consisting of a pair of symmetrical members, or from three components including an integral cast member presenting a cylinder block and a crankcase upper half, a cylinder head and a crankcase half. Accordingly, such a conventional internal combustion engine has various disadvantages to be eliminated or improved: it includes various components which are complicated in configuration, which results in an increase of fastening or binding parts such as bolts which are used in assembling these components; besides, mounting holes must be worked or drilled for individual ones of such components, which results in an increase of working and assembling operations; and hence production costs are inevitably increased; and so on.

The present invention has been thus made, on one hand, to improve such deficiencies of a conventional internal combustion engine, and with particular attention being paid to a structure of an internal combustion engine of the type including a cantilever type crankshaft.

Meanwhile, a four cycle engine including a vertically arranged crankshaft which is used as a general purpose engine and so on, commonly includes an oil lubricating mechanism and a governor mechanism. Since such an oil lubricating mechanism normally includes either an oil pump or an oil raking up blade wheel provided on a separate shaft for effecting lubrication of oil, it is disadventageous in that it requires an increased number of parts and makes the structure thereof complicated, and so on.

Accordingly, the present invention has been made, on the other hand, to improve these disadvantages of an engine which employs an oil raking up type lubricating system.

According to the present invention, there is provided a four cycle internal combustion engine of the type including a cantilever type crankshaft wherein it comprises an outside member including a cylinder block section and a crankcase half section which both are formed into a single body, the crankcase half section having at least a bearing portion for supporting the crankshaft thereon and being open in a direction of an axis of the crankshaft and also in a direction of an axis of an inner bore of a cylinder to define an opening which has an opening edge arranged in an inclined relationship to the center axis of the cylinder and also to the center axis of the crankshaft, and a crankcase half having an inclined opening edge corresponding to the opening edge of the crankcase half section for covering the opening of the crankcase half section.

According to another aspect of the invention, there is provided a four cycle internal combustion engine of the type including a vertically disposed crankshaft and a valve motion wherein it comprises a camshaft disposed perpendicularly to a shaft portion of the crankshaft and connected to the crankshaft such that it is driven by the crankshaft, and a governor slider of a speed governor mechanism provided on an end of the camshaft an including a raking up portion provided thereon for raking up oil.

It is an object of the present invention to provide a four cycle internal combustion engine of the type including a cantilever type crankshaft which includes an outside member whereby parts of complicated configuration can be decreased in number and hence reduction of the total number of components, facilitation of production and assemblage, and reduction of production costs can be easily attained.

It is another object of the invention to provide a four cycle internal combustion engine of the type including a vertically disposed crankshaft and a valve motion in which a structure for lubricating oil is simplified to improve the facility of production and assemlage of the same and hence reduction of production costs can be attained advantageously.

It is a further object of the invention to provide a four cycle internal combustion engine of the type including a cantilever type crankshaft which includes a crankshaft supporting structure which can assure an advantageous operation of the crankshaft by a simplified structure.

Further features, objects and advantages of the present invention will be apparent to those skilled in the art from the following detailed description of preferred embodiments of the invention, taken in conjunction with the accompanying drawings, in which:

DETAILED DESCRIPTION OF THE PREFERRED EMBODIMENTS

Figure 1:
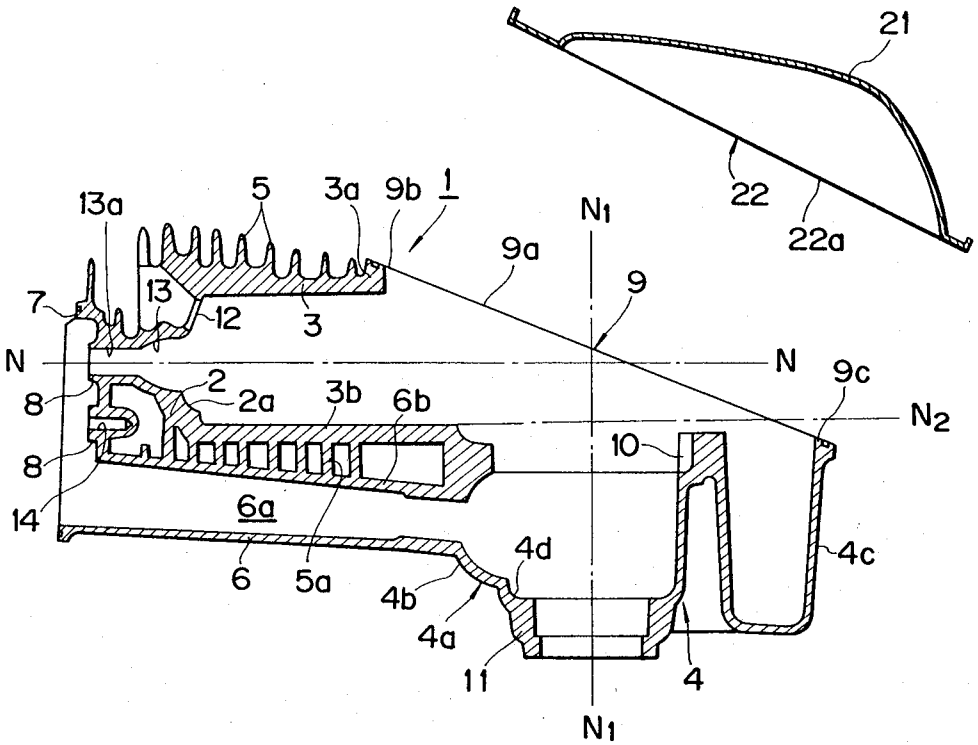
FIG. 1 is a longitudinal sectional view of an outside member in an assembled position of an internal combustion engine according to a first embodiment of the present invention.
Figure 2:
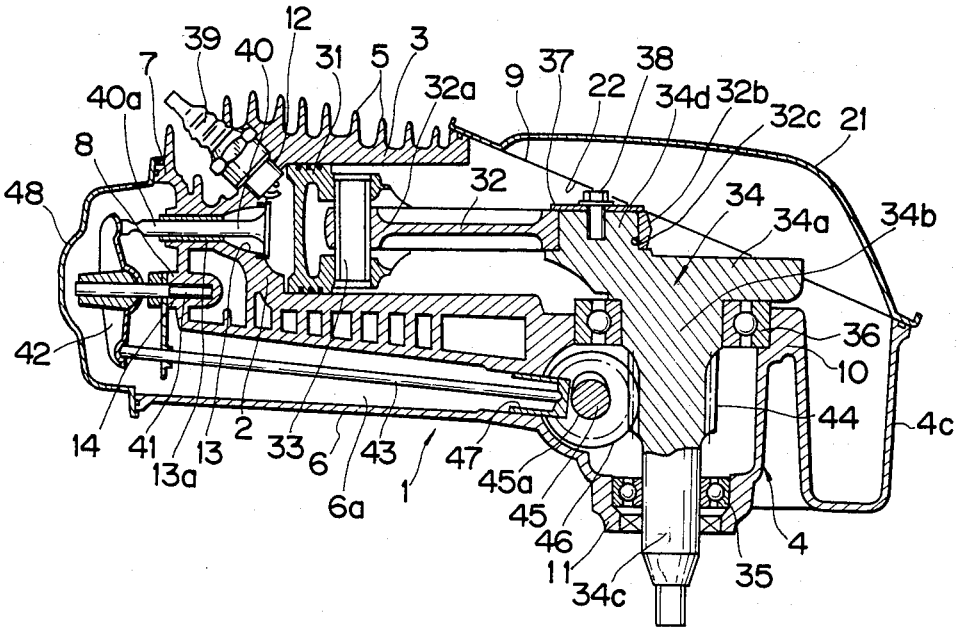
FIG. 2 is a longitudinal sectional view of the internal combustion engine of FIG. 1.

At first, reference is made to FIGS. 1 and 2 in which an internal combustion engine according to a first embodiment of the invention is shown. FIG. 1 illustrates only an outside member of the internal combustion engine which includes a main block 1 and a crankcase half 21. The main block 1 includes a cylinder head section 2, a cylinder block section 3 below the cylinder head section 2, and a crankcase half section 4. These sections 2, 3 and 4 are all casted into a single body, and the cylinder head section 2 and the cylinder block section 3 have each a plurality of cooling fins 5 provided on an outer surface thereof. In the embodiment, the crankcase half section 4 has an opening 9 formed at an end thereof and has a portion 4*a* opposite to the opening 9 and extending therefrom in an axial direction of the crankcase; the crankcase half section 4 is extended from part of an upper wall 4*b* of the portion 4*a* thereof to form a push rod housing 6 in an integral relationship therewith; the housing 6 has therein a passage 6*a* extending in an axial direction of the cylinder; the housing 6 has one end connected to the exdending portion 4*a* of the crankcase half section 4 and the other end extended outwardly beyond the cylinder head section 2 to form a cover mounting portion 7; and the cylinder block section 3 has integrally formed thereon supporting portions 8 which connect with the cover mounting portion 7. Portions 5*a* of the cooling fins 5 are connected to portions 6*b* of an outer wall of the housing 6 to increase the strength of the entire outside member.

The opening 9 is formed to extend from a portion 3*a* of a lower part of an outer periphery of the cylinder block section 3 to bottom portion 4*c* of the crankcase half section 4. An edge 9*a* of the opening 9 is in a plane which is in an inclined relationship to a cylinder center axis N—N and also to a crankshaft center axis N1—N1 and the top end 9*b* of the opening edge 9*a* is adjacent a part 3*a* of a lower portion of the cylinder block 3 forwardly (upwardly) of the crankshaft axis while the bottom end 9*c* of the opening edge 9*a* is located rearwardly of an extension line N2 of an inner bore 3*b* of the cylinder block 3. The crankcase half section 4 has a bearing portion 11 for a crankshaft formed on an end wall 4*d* thereof and has another bearing portion 10 formed on a portion thereof adjacent the opening 9*a*. The cylinder head section 2 has an igition plug mounting hole 12 formed in a side portion thereof and suction and exhaust valve ports 13 formed in a top potion 2*a* thereof. Outwardly of the suction and exhaust valve ports 13, the cylinder head section 2 further has a valve rod receiving hole 13*a* formed to extend through one of the supporting portions thereof and a supporting hole 14 formed to extend through the other supporting portion thereof.

Drilling of holes and openings in the cylinder head, working of the ceiling and machining of the inner bore of the cylinder can all be carried out from below the cylinder inner bore. Since the opening 9 is in an inclined position and is opened outside an extension line of the cylinder inner bore, such machining can be carried out easily without a trouble. Also, working of the bearing portions 10 and 11 can be easily carried out through the opening 9 without a trouble since the opening 9 is open from a lower part of the cylinder block section to the bottom of the crankcase half section.

The crankcase half 21 is in the form of a cap and has an inclined opening edge 22*a* which corresponds to the opening edge 9*a*. the crankshaft half 21 may be either a part made of a steel plate and shaped by press work or a part molded from an aluminum alloy or a synthetic resin material. The crankcase half 21 is placed on the crankcase half section 4 such that the the opening edge 22*a* thereof is opposed to the opening edge 9*a* of the crankcase half section 4 with a packing or the like interposed therebetween and is fastened thereto by means of a bolt or the like.

Preceding to such fastening of the crankcase half 21, inside components are assembled to the main block 1. In particular, as seen in FIG. 2, a journal section of a cantilever type crankshaft 34 is inserted through the crankcase half section 4 to mount the crankshaft 34 on the main block 1 and then a minor end 32*a* of a con'rod 32 is connected to a piston 31 by means of a pin 33. The journal section includes a first journal portion 34*b* which is downstream of a web 34*a* and a second journal portion 34*c* which is further downstream of the web 34*a*. The second journal portion 34*c* is supported by the bearing portion 11 through a bearing 35 while the first journal portion 34*b* is supported by the bearing portion 10 through another bearing 36. The opposite major end 32*b* of the con'rod 32 has a hole 32*c* which receives therein a pin portion 34*d* formed on and adjacent one end of the web 34*a*. A stopper 37 is placed on the pin portion 34*d* and the major end 32*b* of the con'rod 32 from outside and is fastened thereto by means of a bolt 38 so as to prevent the con'rod 32 from being removed from the crankshaft 34. An ignition plug 39 is screwed into the opening 12 of the cylinder head section 2 and one of suction and exhaust valves 40 is fitted in the opening 13 with a stem 40*a* thereof extending through the hole 13*a* of the opening 13. An end of the stem 40*a* of the valve 40 is engaged with one end of a rocker arm 42 supported on a support member 41 which is in turn supported in the supporting hole 14 of the supporting portion 8. The other end of the rocker arm 42 is engaged with one of a push rod 43 which extends in the direction of the cylinder axis through the passage 6*a* within the housing 6. In the meantime, a cam shaft driving gear portion 44 is provided between the first and second journal portions 34*b*, 34*c* of the crankshaft 34 and is meshed with a driven gear 46 on a cam shaft 45 which is disposed perpendicularly to the crankshaft 34. The cam shaft 45 has a cam section 45*a* which is engaged with a valve lifter 47 which is in turn engaged with the opposite end of the push rod 43, thereby constituting a valve motion. A cover 48 is provided which is disposed over the cylinder head section 2 to cover the valve motion from above.

It is to be noted that, while the embodiment is designed as an overhead valve engine, the present invention can be easily applied to a side valve engine. Also, while the cylinder head section of the embodiment is formed in an integral relationship with other sections of the engine, it may be formed as a separate body.

Figure 3:
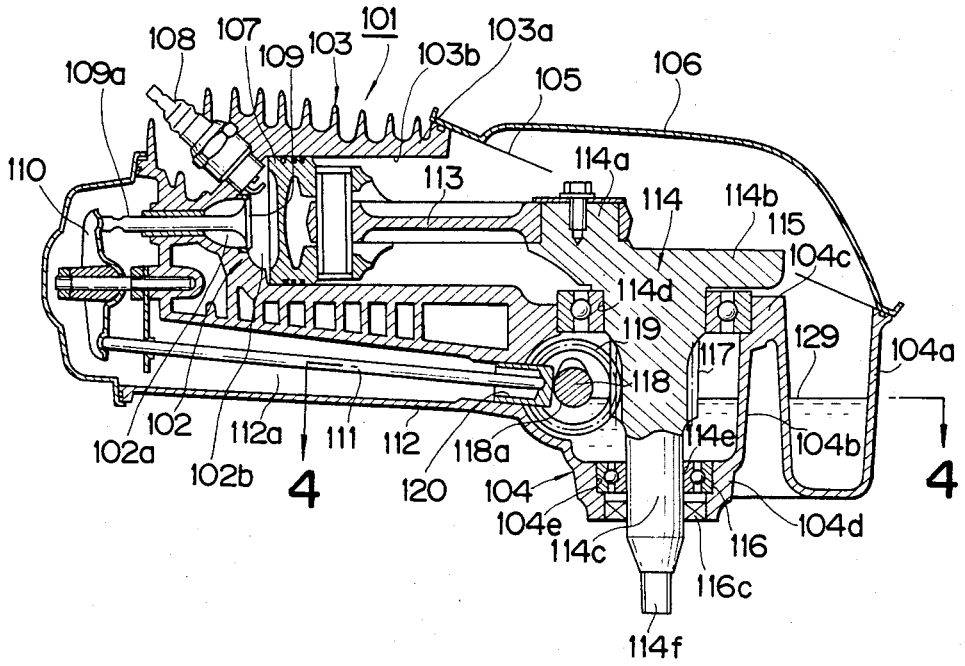
FIG. 3 is a longitudinal sectional view of an internal combustion engine according to a second embodiment of the invention.
Figure 4:
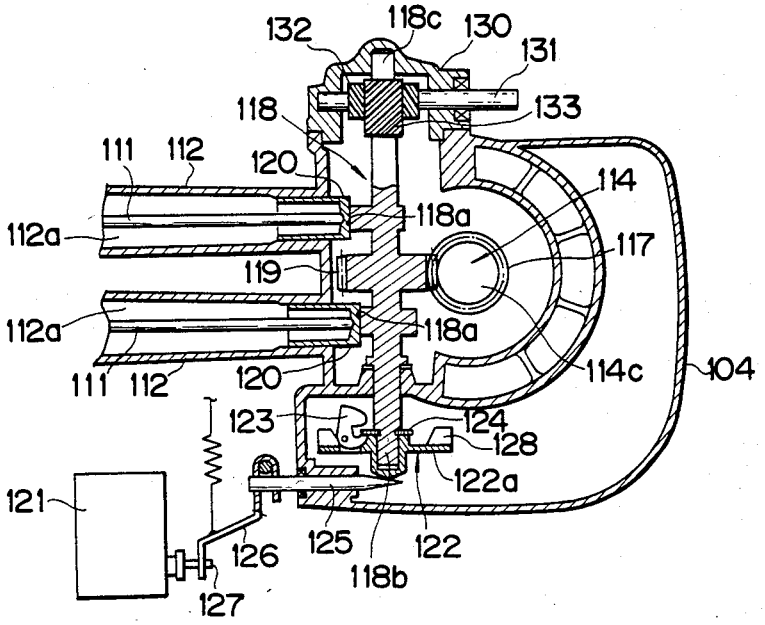
FIG. 4 is a transverse sectional view of the internal combustion engine of FIG. 3, as seen from above.
Figure 5:
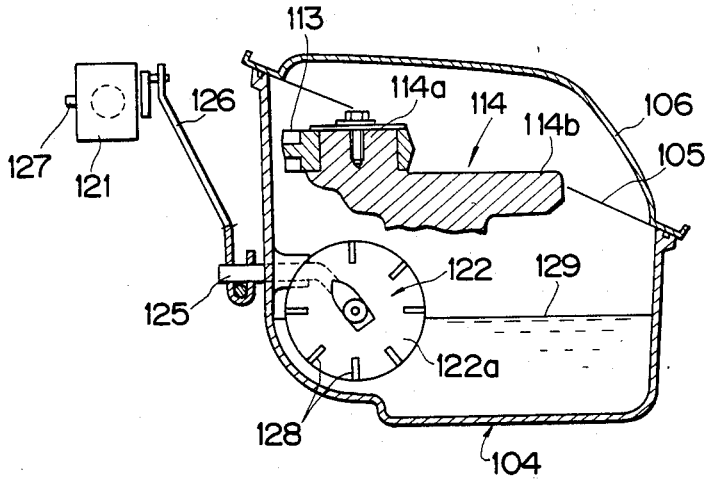
FIG. 5 is a transverse sectional view of the internal combustion engine of FIG. 3, as seen from below.

Referring now to FIGS. 3 to 5, there is illustrated an internal combustion engine according to a second embodiment of the invention. The internal combustion engine is generally designated by reference numeral 101 and includes a cylinder head section 102, a cylinder block section 103 and a crankcase section 104 which sections are all casted into a single body. The crankcase section 104 has an opening 105 formed at an end thereof adjacent a crankshaft 114. The opening 105 is inclined relative to an axis of the crankshaft 114 and also to an axis of a cylinder 103*a* and extends from a base end of the cylinder block section 103 to a bottom portion 104*a* of the crankcase section 104 which is located outwardly as viewed from an inner bore 103*b* of the cylinder 103*a*. The opening 105 is closed up with a cover 106 made of a steel plate or the like. A piston 107 is fitted for sliding motion in the horizontal cylinder inner bore 103*b* the cylinder block section 103. The cylinder head section 102 has an ignition plug 108 mounted in an inclined position therein and also has a pair of valves 109 (only one is shown in the drawings) disposed in a vertical direction in a central portion thereof and operable to open and close suction and exhaust passages 102*a* and a combustion chamber 102*b*. A stem 109*a* of each valve 109 extends outwardly through the head section 102 and has an outer end thereof engaengaged with an end of one of a pair of valve rocker arms 110. The other end of each rocker arm 110 is engaged with an end of one of a pair of push rods 111 which are disposed in a substantially parallel relationship to the axis of the cylinder 103*a*. The crankcase section 104 has a downwardly extending supporting portion 104*b* provided at a portion thereof outwardly of the cylinder block section 103. A first bearing portion 104*c* is provided at a portion of the crankcase section 104 above the supporting portion 104*b* in a position on an extension line of the cylinder inner bore 103*b* while a second bearing portion 104*e* is provided at a lower end wall 104*d* of the crankcase section 104 in a spaced relationship in a direction of the axis of the crankshaft 114 from the first bearing portion 104*c*. The crankcase section 104 further has a pair of push rod housing portions 112 provided adjacent the cylinder block section 103 between the first and second bearing portions 104*c* and 104*e* and extending in a parallel relationship to the cylinder block section 103. Each housing portion 112 has a passage 112*a* therein which has one end communicated with the inside of the supporting portion 104*a* of the crankcase section 104 and the other end opened within the cylinder head section 102. The piston 107 is connected to a minor end of a con'rod 113, which has a major end thereof connected to a pin portion 114*a* of the cantilever type crankshaft 114. Thus, also according to this embodiment, machining of the cylinder inner bore 103*a* and the first and second bearing portions 104*c* and 104*e* can be carried out easily since, while the cylinder head section 102, the cylinder block section 103 and the crankcase section 104 are all casted into a single block, the opening 105 is formed in an inclined relationship as described above. The crankshaft 114 has a web 114*b* adjacent the pin portion 114*a* thereof and a shaft portion 114*c* extending downwardly from the web 114*b*. A first journal portion 114*d* of the shaft portion 114*c* of the crankshaft 114 adjacent the web 114*b* is supported by the bearing portion 104*c* through a bearing 115 while a second journal portion 114*e* adjacent the lower end of the shaft portion 114*c* is supported by the bearing portion 104*e* through a bearing 116. The lower end of the shaft portion 114*c* extends outwardly through the end wall 104*d* to form an output portion 114*f*. An oil seal 116*c* is provided for the crankshaft 114 outwardly of the bearing 116.

A toothed gear 117 is formed around an outer periphery of the shaft portion 114*c* of the crankshaft 114 between the bearings 115 and 116 and is meshed with another toothed gear 119 formed on a camshaft 118 which is disposed perpendicularly to the shaft portion 114*c* of the crankshaft 114. In the meantime, the push rods 111 are disposed to extend through the passage 112*a* within the housing 112 as described hereinbefore and have their ends engaged with cam portions 118*a* of the camshaft 118 via respective lifters 120. A governor slider 122 is mounted for integral rotation with and for axial sliding motion on an end 118*b* of the camshaft 118 which is nearer to a carburettor 121 disposed externally of the engine 101. The slider 122 holds thereon a centrifugally diffusing weight 123 which has a base portion thereof engaged with a stopper 124 for the slider 122 mounted at the end 118*b* of the camshaft 118. If the crankshaft 114 is driven to rotate the camshaft 118 at a predetermined rotational frequency, then the weight 123 is thrown open outwardly to slide the slider 122 in an axial direction on the camshaft 18. The axial motion of the slider 122 is imparted to a motion transmitting rod 125 which is bent in configuration as shown in FIG. 5. The rod 125 has one end connected to the slider 122 and has the opposite end extending outwardly of the crankcase section 104 and connected to one end of a connecting rod 126 which has its opposite end connected to a throttle valve shaft 27 of the carburettor 121 in order to effect speed governing in a known manner. The governor slider 122 has a portion 122*a* in the form of a disk as seen in FIG. 5. The disk-formed portion 122*a* has a plurality of radial blades 128 provided on one face thereof and almost a half of the portion 122*a* is sunk under oil 129 collected on the bottom of the crankcase section 104 in order that the oil 129 may be raked up by the blades 128 to effect intended lubrication when the camshaft 118 is rotated.

The camshaft 118 has the opposite end 118*c* journalled in a side cover 130 for the crankcase section 104, as seen in FIG. 4. An output power shaft 131 is mounted on the cover 130 and is arranged perpendicularly to the camshaft 118. The output power shaft 131 is connected to the camshaft 118 through a gearing including a gear 132 mounted on the output power shaft 131 and another gear 133 mounted at the end 118*c* of the camshaft 118 so as to obtain an output power from the camshaft 118. It is to be noted that the camshaft may otherwise have an end extended outwardly of the cover so as to provide an output power portion instead of the output power shaft of the embodiment.

It is also to be noted that, while the embodiment just described includes a cantilever type crankshaft, the present invention may also be applied to an engine which includes a center crankshaft therein.

Figure 6:
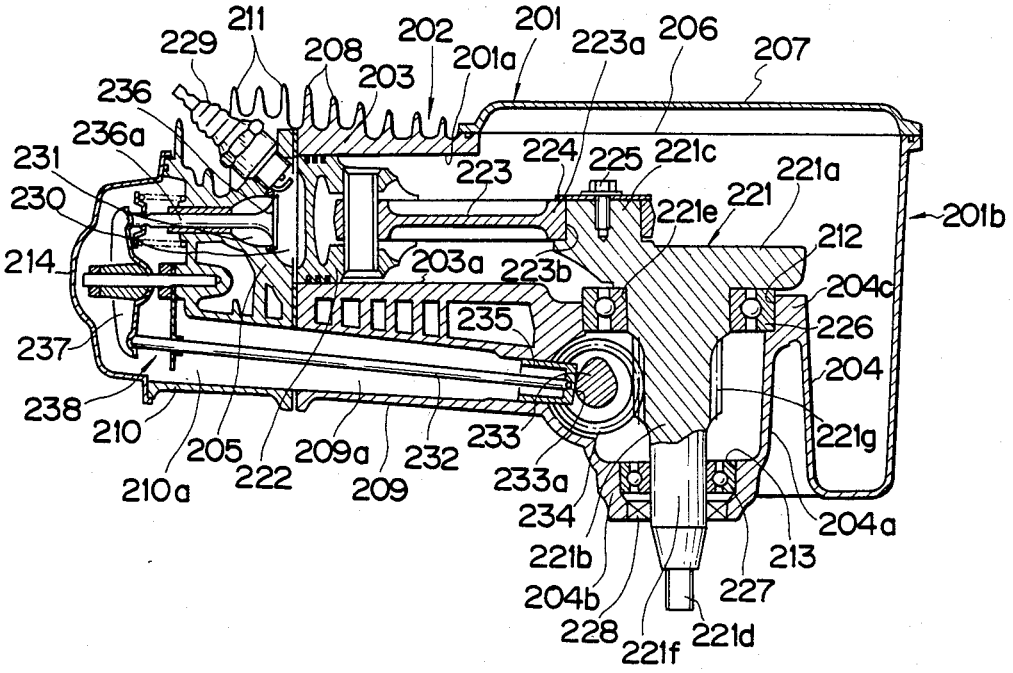
FIG. 6 is a longitudinal sectional view of an internal combustion engine according to a third embodiment of the invention.

Now, reference is made to FIG. 6 which illustrates an internal combustion engine 201 according to a third embodiment of the invention. The internal combustion engine 201 has an outside member 201*b* including a main block 202 which in turn includes a cylinder block section 203 constituting a circumferential wall for a cylinder chamber 201*a* and a crankcase section 204 for accommodating a crankshaft 221 therein which section 204 is made by casting in an integral relationship with the cylinder block section 203. The outside member 201*b* further includes a cylinder head 205 mounted to cover the cylinder block section 203, and a cover 207 for covering an opening 206 which is open to one side of the engine 201 and extends from a lower end of the cylinder block section 203 to the bottom of the crankcase section 204 of the main block 202. On the opposite side to the opening 206, the cylinder block section 203 has a housing 209 for accommodating therein push rods 232 formed in an integral relationship therewith and also in a mutually continued relationship with a plurality of cooling fins 208 on an outer surface of the cylinder block section 203 in such a manner as to constitute a part of the main block 202. A lower end of the housing 209 is continued to a shaft supporting portion 204*a* of the crankcase section 204 which extends in a direction away from the opening 206. The passage 209*a* is formed in the housing 209 in a substantially parallel relationship to an axis of the cylinder chamber 201*a* and communicates with the inside of the shaft supporting portion 204*a* of the crankcase section 204. On the same side with the housing 209, the cylinder head 205 has an extension 210 formed in an integral relationship therewith which is joined together to the housing 209 during assembly. Also, the cylinder head 205 has a plurality of cooling fins 211 formed around an outer periphery thereof. The cylinder head 205 having such a construction as described above is joined together to the top of the cylinder block section 203, and then the cover 207 is joined together to close up the opening 206. Interior parts are then assembled to the thus constituted outside member 201*b*.

A crankshaft 221 is of the cantilever type in which a shaft portion 221*b* is extended to one side of a web 221*a* thereof. The web 221*a* has a pin portion 221*c* provided at an eccentric position on an end face thereof and fitted in a direction of an axis of the crankshaft 221 in a hole 223*b* formed in a major end 223*a* of a con'rod 223 to thereby connect the crankshaft 221 to the major end 223*a* of the con'rod 223 by means of a stopper 224 and a bolt 225. The con'rod 223 thus connects the crankshaft 221 to a piston 222 which is fitted in an inner bore 203*a* of the cylinder chamber 201*a*. The shaft portion 221*b* of the crankshaft 221 has an output power end 221*d* extending outwardly of an outer end wall 204*b* of the crankcase section 204. Bearing portions 212 and 213 are provided in a concentrical and axially spaced relationship with the crankshaft 221 in a partition wall 204*c* on one side directly below the inner bore 203*a* of the cylinder chamber 201*a* and in the end wall 204*b*, respectively. Bearings 226 and 227 are fitted in the bearing portions 212 and 213, respectively, and support thereon a first journal portion 221*e* of the shaft portion 221*b* of the crankshaft 221 adjacent the web 221*a* and a second journal portion 221*f* adjacent the output portion 221*d* of the crankshaft shaft portion 221*b*.

In this way, the cantilever type crankshaft 221 is supported at two axially spaced points thereof thereby to bear two opposite forces applied thereto to assure smooth rotation of the crankshaft 221. Besides, since one of the support points is located adjacent the crank web 221*a* near to the cylinder chamber 201*a*, a load applied to the crankshaft 221 is advantageously carried at the support point thereof. An oil seal 228 is also provided for the crankshaft 221.

The cylinder head 205 has an ignition plug 229 mounted thereon and also has suction and exhaust valves 236 (only one is shown in FIG. 6) mounted thereon which communicate and discommunicate a combustion chamber 230 and suction and exhaust air passages 231 (only one is shown in FIG. 6) with each other. A stem 236*a* of each of the suction and exhaust valves 236 extends upwardly through the cylinder head 205 and has an end engaged with one end of a valve rocker arm 237 which has its opposite end engaged with an upper end of a push rod 232. The push rod 232 extends downwardly through a passage 210*a* within the housing extension 210 and the passage 209*a* within the housing 209 towards the shaft portion 221*b* of the crankshaft 221. A toothed gear 221*g* is formed around an outer periphery of a portion of the shaft portion 221*b* between the points 221*e* and 221*f* at which the crankshaft 221 is supported. The toothed gear 221*g* is meshed with another toothed gear 234 formed on a camshaft 233 which is disposed perpendicularly to the crankshaft 221. The opposite lower end of the push rod 232 is engaged with a lifter 235 which has an outer surface thereof engaged with a cam portion 233*a* of the camshaft 233, thereby constituting a valve motion 238 for actuating the suction and exhaust valves 236. Since the shaft portion 221*b* of the crankshaft 221 is supported at two spaced points thereof, smooth rotation of the crankshaft 221 is assured thereby and accordingly, operation of the valves 236 by the cam shaft 233 can be effected accurately. A cover 214 is provided which covers the valve motion 238 over the cylinder head 205.

Figure 7:
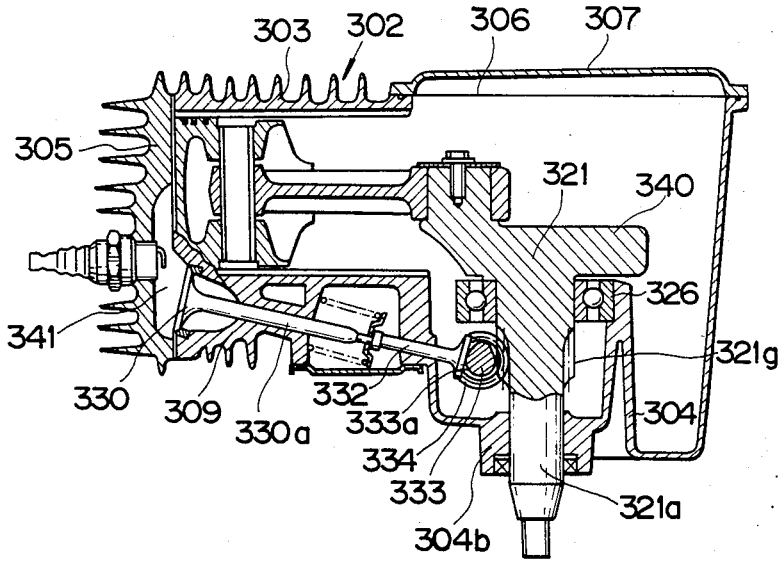
FIG. 7 is a longitudinal sectional view of an internal combustion engine according to a fourth embodiment of the invention.

While overhead valve engines have been described so far to which the present invention is applied, an embodiment of a side valve engine is described in the followings by referring to FIG. 7. The engine includes a main block 302 which includes a cylinder block section 303 and a crankcase section 304. The crankcase section 304 has an upward opening 306 formed therein which is covered with a cover 307 while the cylinder block section 303 has a valve stem guide portion 309 integrally provided thereon. The crankshaft 321 has a web 340 and is supported at a portion thereof adjacent the web 340 by means of a bearing 326 and also at another portion thereof by means of a bearing portion 304*b* formed directly in a lower end wall of the crankcase section 304. A toothed gear 321*g* is formed on a vertically intermediate portion of a shaft portion 321*a* of the crankshaft 321 and is meshed with another toothed gear 334 formed on a camshaft 333 which has a cam portion 333*a* engaged with one end of a push rod 332. The push rod 332 has the opposite end thereof engaged with an end of a stem portion 330*a* of a valve 330 which extends through the guide portion 309 of the cylinder block section 303. The valve 330 faces a combustion chamber 341 within the cylinder head 305.

We claim:

1. A four cycle internal combustion engine comprising:

a vertically disposed cantilever crankshaft having a shaft portion and a center axis;

a main block including a cylinder block section having an inner bore with a horizontal axis, and a crankcase half section, said cylinder block section and said crankcase half section being formed as a single body, said crankcase half section having a bearing portion for supporting said crankshaft thereon, said shaft portion of said crankshaft being supported at two points of said bearing portion, one of said points being below and near to said inner bore and the other of said points being spaced downwardly therefrom, said crankcase half section being upwardly open in a direction of said center axis of said crankshaft and also in a direction of said horizontal axis of said inner bore to define an opening which has an opening edge arranged in an inclined relationship to said center axis of said crankshaft and also to said horizontal axis of said inner bore;

a camshaft rotatably mounted in said crankcase half section and disposed perpendicularly to said center axis of said crankshaft at a position wholly between a respective horizontal plane passing through each of said two points of said bearing portion; and a crankcase half having an inclined opening edge corresponding to said opening edge of said crankcase half section for covering said opening of said crankcase half section.

2. The four cycle internal combustion engine according to claim 1, further comprising a governor slider of a speed governor mechanism provided on an end of said camshaft and including a raking up portion provided thereon for raking up oil held in said crankshaft half section.

* * * * *